US008212770B2

(12) United States Patent
Obourn et al.

(10) Patent No.: US 8,212,770 B2
(45) Date of Patent: Jul. 3, 2012

(54) JOYSTICK ASSEMBLY FOR IMPROVED MACHINE CONTROL

(75) Inventors: Roger G. Obourn, Washington, IL (US); Matthew Vazquez, Peoria, IL (US); Gregory R. Kopp, Dunlap, IL (US); Daniel E. Shearer, Metamora, IL (US); Robert L. Stamate, Chillicothe, IL (US); Gregory A. Stievenart, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 659 days.

(21) Appl. No.: 12/368,619

(22) Filed: Feb. 10, 2009

(65) Prior Publication Data

US 2009/0201250 A1 Aug. 13, 2009

Related U.S. Application Data

(60) Provisional application No. 61/027,819, filed on Feb. 11, 2008.

(51) Int. Cl.
*G09G 5/08* (2006.01)

(52) U.S. Cl. ..... 345/161; 463/37; 463/38; 74/471 XY; 345/156

(58) Field of Classification Search ..... 345/156–162; 463/37–38; 74/471 XY
See application file for complete search history.

(56) References Cited

U.S. PATENT DOCUMENTS

| | | | | |
|---|---|---|---|---|
| 3,394,611 | A | 7/1968 | Beurrier | |
| 3,941,009 | A | 3/1976 | Brown | |
| 4,332,177 | A | 6/1982 | Andresen | |
| 4,451,986 | A * | 6/1984 | Jones, Jr. | 33/720 |
| 4,574,651 | A | 3/1986 | Nordstrom | |
| 4,575,591 | A | 3/1986 | Lugaresi | |
| 4,615,311 | A * | 10/1986 | Scheckel | 123/179.24 |
| 4,884,057 | A | 11/1989 | Leorat | |
| 4,945,357 | A | 7/1990 | Tal | |
| 4,976,435 | A * | 12/1990 | Shatford et al. | 463/36 |
| 5,481,077 | A | 1/1996 | Clegg et al. | |
| 5,503,040 | A | 4/1996 | Wright | |
| 5,533,590 | A | 7/1996 | Steffen et al. | |
| 5,585,608 | A | 12/1996 | Kraemer | |
| 5,663,747 | A * | 9/1997 | Shulman | 345/161 |
| 5,714,727 | A * | 2/1998 | Lecznar et al. | 200/61.54 |
| 5,810,606 | A * | 9/1998 | Ballast et al. | 439/15 |
| 5,995,034 | A * | 11/1999 | Liu | 341/161 |
| 6,178,841 | B1 | 1/2001 | Ruckert et al. | |
| 6,208,328 | B1 | 3/2001 | Kawachiya et al. | |
| H2024 | H | 6/2002 | Kelley et al. | |
| 6,429,849 | B1 * | 8/2002 | An et al. | 345/161 |
| 6,664,666 | B2 * | 12/2003 | Corcoran | 310/12.23 |
| 6,697,049 | B2 | 2/2004 | Lu | |
| 6,778,166 | B2 | 8/2004 | Lin | |

(Continued)

FOREIGN PATENT DOCUMENTS

WO 9426549 11/1994

*Primary Examiner* — Lun-Yi Lao
*Assistant Examiner* — Gene W Lee
(74) *Attorney, Agent, or Firm* — David E. Roberts; M. Daniel Spillman

(57) ABSTRACT

A joystick assembly that provides enhanced operator control and stability during rough operation by being primarily rotatable about a vertical axis of a clockspring. The joystick assembly also includes a palm support that is associated with the clockspring via a clamp in the lower housing of the palm support. Further, the joystick assembly has an interface device that includes at least one input device that is conveniently actuated by an operator's thumb.

15 Claims, 6 Drawing Sheets

U.S. PATENT DOCUMENTS

| | | | | |
|---|---|---|---|---|
| 7,036,250 | B2 | 5/2006 | Dressler et al. | |
| D526,757 | S | 8/2006 | Bergman et al. | |
| 2003/0058219 | A1* | 3/2003 | Shaw | 345/161 |
| 2005/0068295 | A1* | 3/2005 | Schottler et al. | 345/161 |
| 2006/0044269 | A1* | 3/2006 | Bloch | 345/161 |
| 2006/0156848 | A1 | 7/2006 | Gosselin et al. | |
| 2007/0004549 | A1* | 1/2007 | Chryssochoos et al. | 475/149 |
| 2008/0306668 | A1* | 12/2008 | Wang et al. | 701/93 |

* cited by examiner

JOYSTICK ASSEMBLY FOR IMPROVED MACHINE CONTROL

TECHNICAL FIELD

This disclosure relates generally to operator interfaces, and more specifically, to joysticks for operating machines.

BACKGROUND

When considering the interface of an operator and a machine, a better understanding of kinesiology and improved technological features have lead to the development of improved control interfaces. Such interfaces may be added to machines to improve their functionality, efficiency, and general usefulness, while also reducing the negative impact on the operator's health from poor ergonomics. However, such interfaces may create inefficiency via awkward placement of controls or switches or they may create new ergonomic problems for the operator. Also, some improved interfaces may focus disproportionately on ergonomics while disregarding the design's impact on the precision of the machine's operation or the reliability of the interface.

The present invention is directed to overcome one or more of the problems as set forth above.

SUMMARY OF THE INVENTION

In one embodiment, the present disclosure is directed to a joystick assembly comprising a base including a main harness and a clockspring, the clockspring having a vertical axis. The joystick assembly further comprises a palm support including an upper housing, a lower housing, a clamp, a data wire, and a data wire connector. Additionally, the joystick assembly comprises an interface device. The joystick assembly is rotatable about the vertical axis of the clockspring, the vertical axis being generally perpendicular to the upper housing.

DETAILED DESCRIPTION

Figure 1:
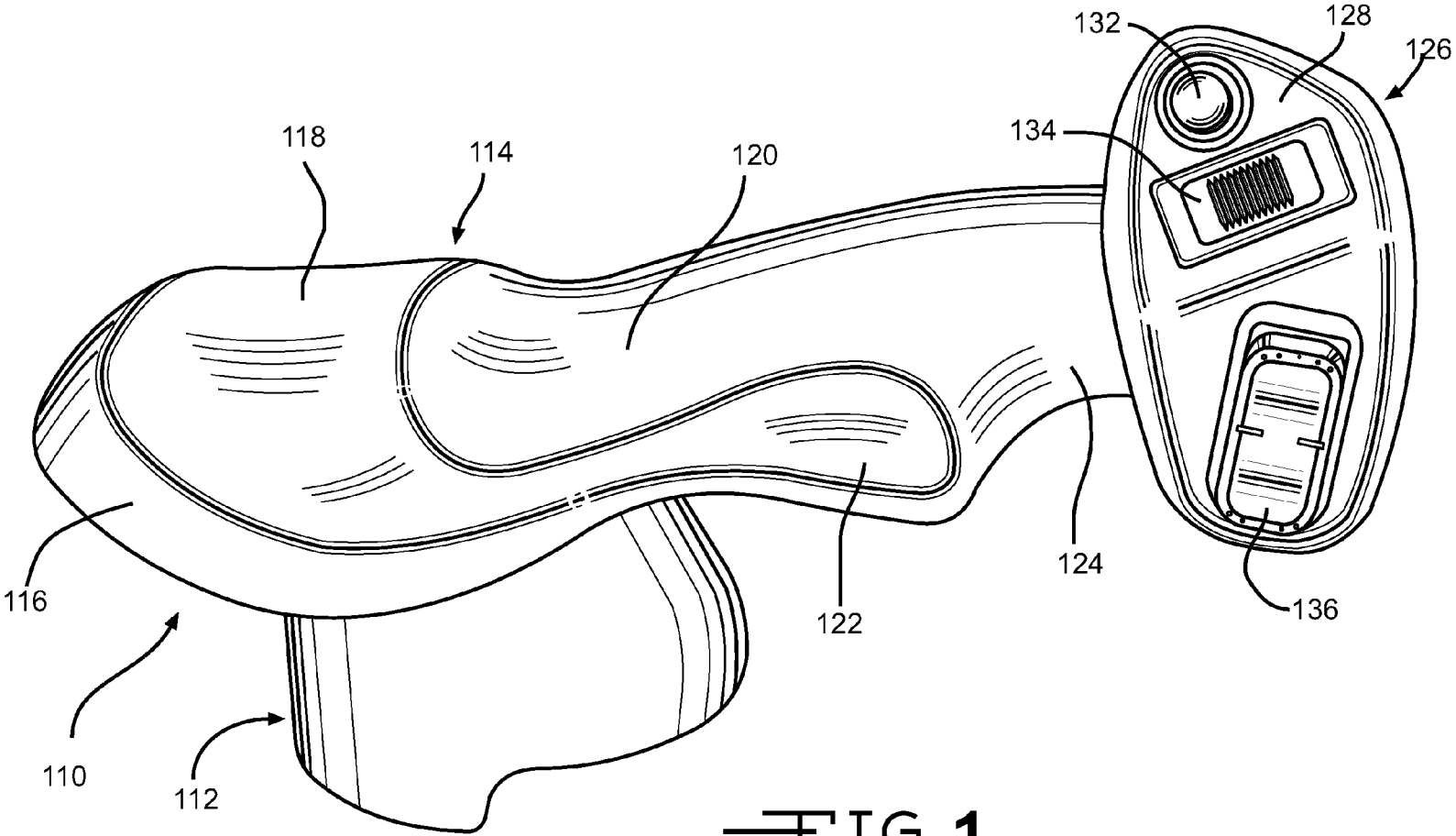
FIG. 1 is a schematic representation of a left-handed joystick according to the present disclosure.
Figure 4:
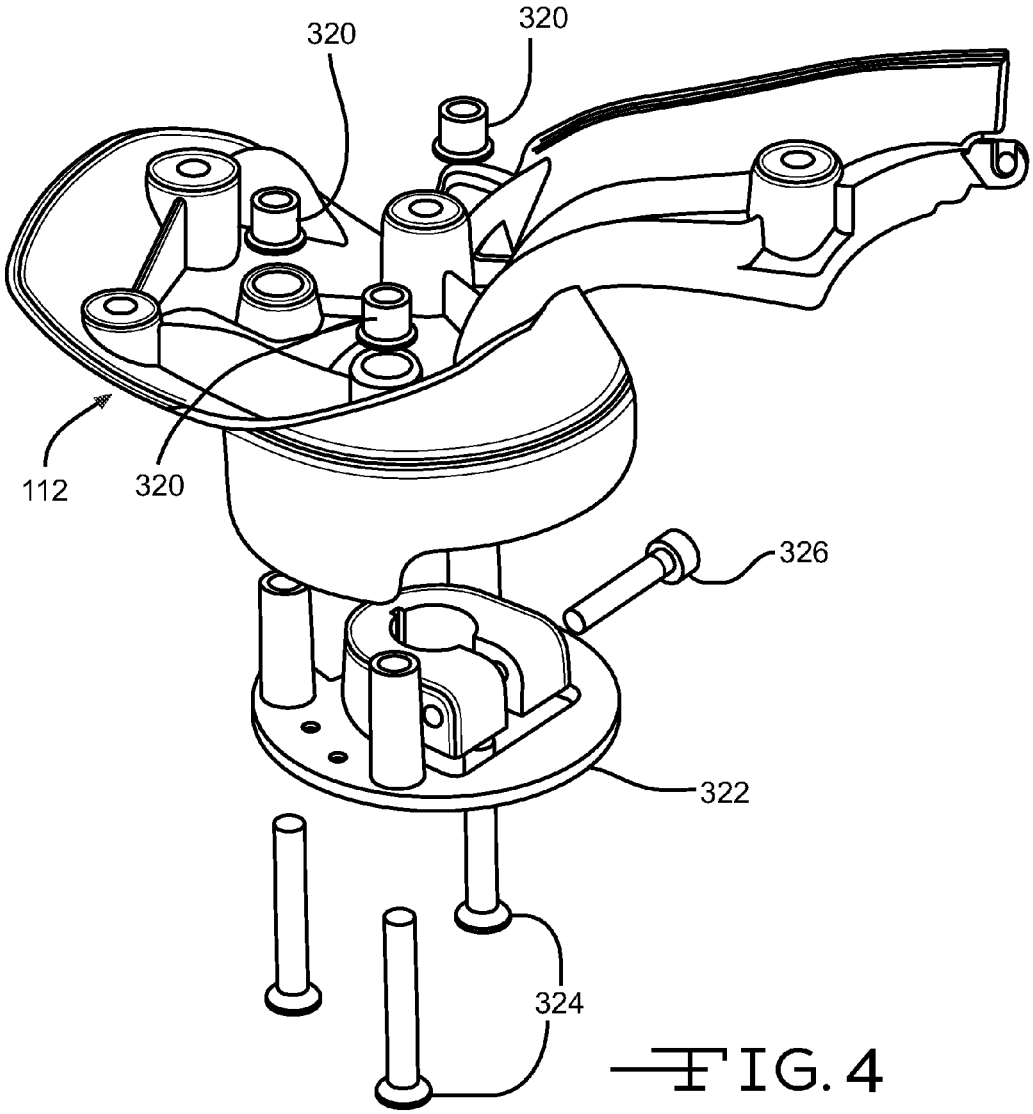
FIG. 4 is exploded views of a lower housing of the joystick of FIG. 1.
Figure 5:
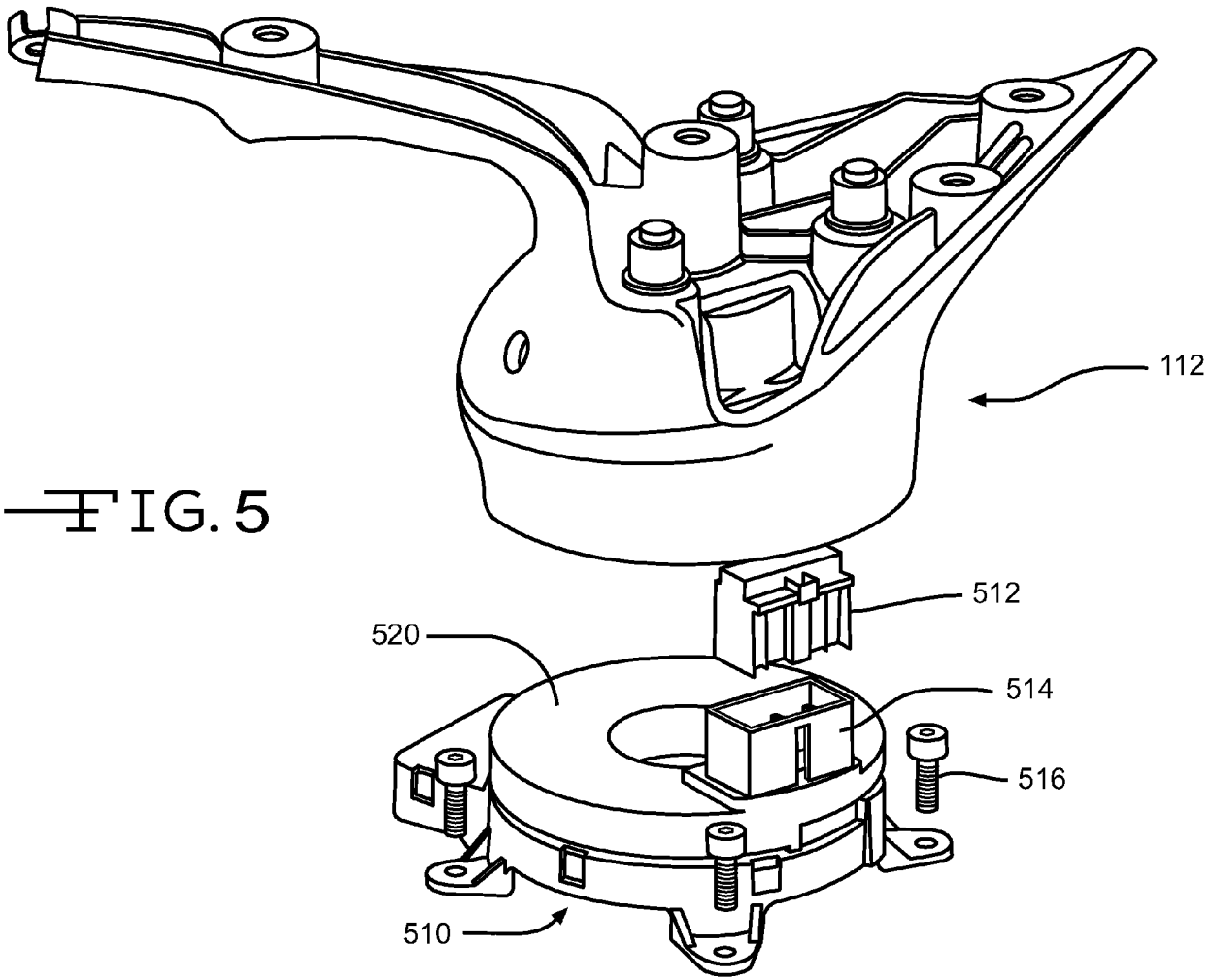
FIG. 5 is exploded views of a supporting assembly, which comprises the hand support's lower housing of FIG. 4 and a clockspring.

Referring to FIG. 1, a schematic representation of a left-handed version of a joystick assembly according to this disclosure, an upper housing 114 is joined with a lower housing 112 to form a palm support 110. Referring to FIGS. 4 and 5, the palm support 110 is connected to a clockspring 520 at one end of the lower housing via a clamp 322. The palm support 110 is also directly connected to an interface device 126, which is adapted for receiving operator input and positioned on the end of the palm support 110 distal from the area of the lower housing that connects to the clockspring 520. Accordingly, the joystick assembly immediately disclosed is rotatable about a vertical axis, with the vertical axis being generally perpendicular to the upper housing. While FIG. 1 and the remainder of this disclosure generally describe a left-handed version of the joystick assembly at times, it is to be understood that the invention also envisions a right-handed joystick assembly configuration.

With further reference to FIG. 1, the upper housing 114 is rigidly formed and adapted to provide an area on which the operator's palm may be placed during operation. As displayed in the embodiment of FIG. 1, upper housing 114 may be adapted to have multiple contours, such that an operator's palm may comfortably rest on upper housing 114 while providing adequate support during operation. The contours of upper housing 114 are designed such that the operator's arm may rest on an armrest when the joystick assembly is attached to a seat, which promotes greater operator stability during operation over rough terrain. For example, in one embodiment, upper housing 114 has a ducktail 116, two resting areas 118 and 120, a thumb rest area 122, and a grip area 124. Moreover, the operator's stability—and the attendant enhanced machine control—is furthered by the rigid form of the palm support 110.

Figure 3:
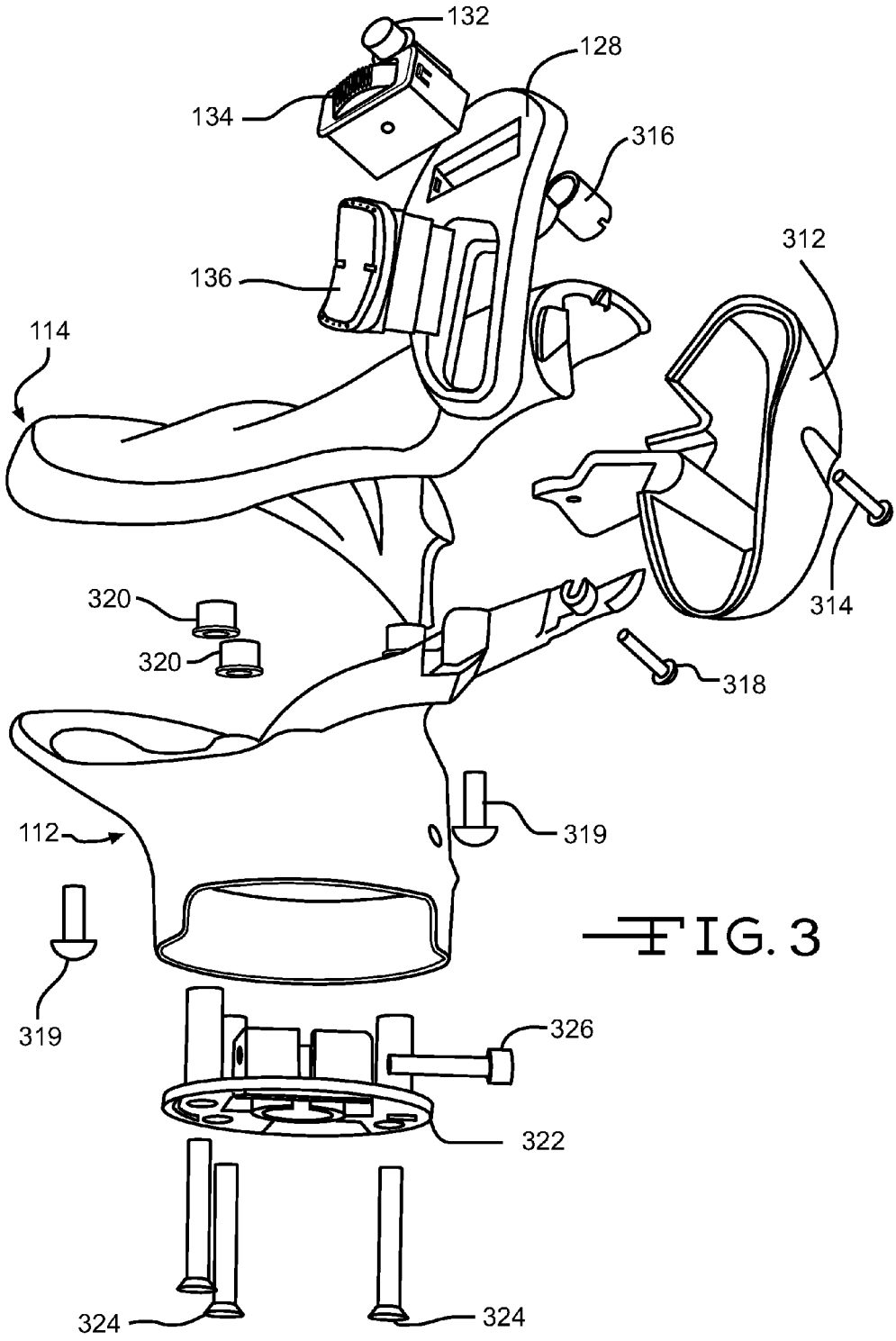
FIG. 3 is an exploded view of the joystick of FIG. 1.

Regarding the lower housing 112, the lower housing 112 may be integrally formed with upper housing 114, or the upper and lower housings may be joined using any generally known joining mechanisms, such as adhesives, glues, or fasteners. As shown in FIG. 3, palm support 110 may be joined via palm support fastener 319.

Figure 2:
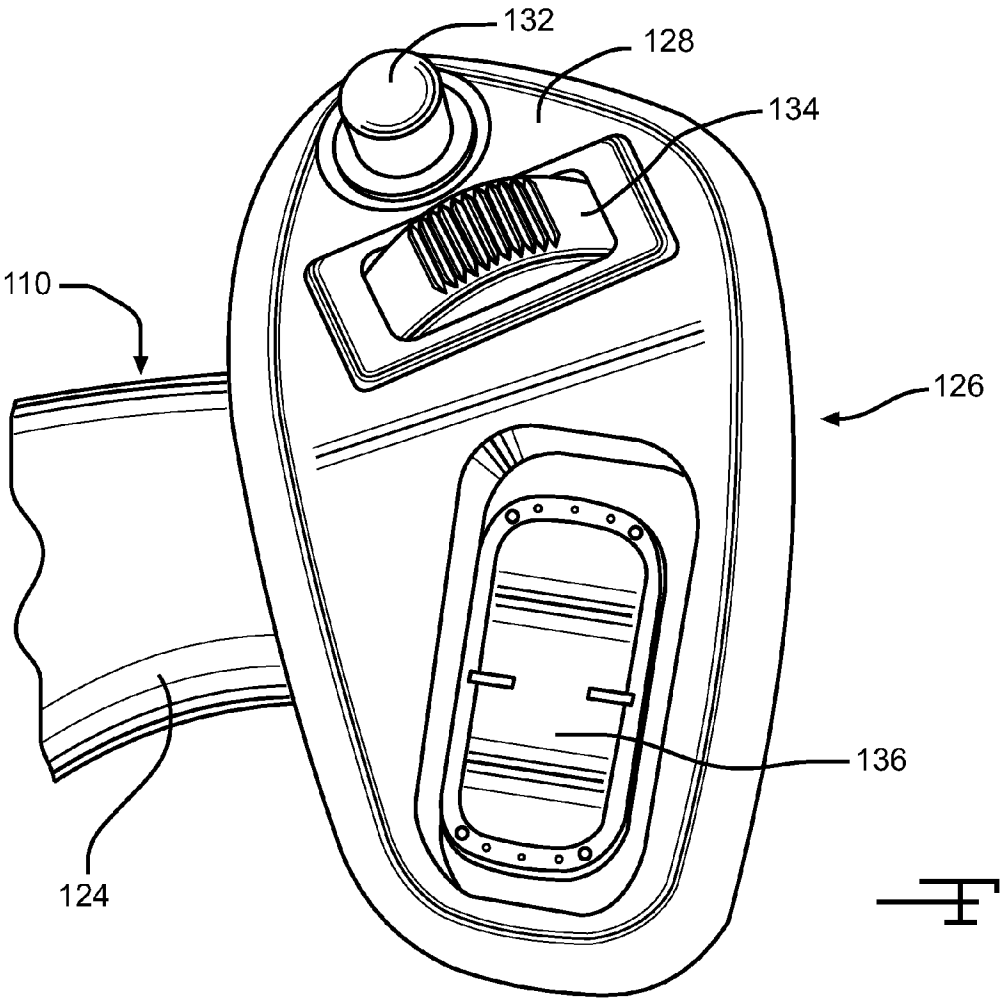
FIG. 2 is a schematic representation of an operator input head of the joystick shown in FIG. 1.

As seen in FIG. 2, the joystick assembly also includes an interface device 126 joined to palm support 110 proximate grip area 124. Interface device 126 may be formed integrally with palm support 110, or interface device 126 may be attached to palm support 110 via at least one palm support fastener 319, as shown in FIG. 3. Interface device 126 includes at least one input device on a faceplate 128 that is designed to control a specific function of the machine. The input device may be any type of input device known in the art, such as a push button, a switch, a lever, a roller, a key pad, or touch pad. Interface device 126 may comprise an interface device body 312 and faceplate 128, which may be integrally formed with one another, may snap fit with one another, or may be joined via any other known joining mechanism, such as via an interface device fastener 314, as shown in FIG. 3. Securing member 316 may be configured to secure one or more input devices.

Further, faceplate 128 of interface device 126 may have a contour to create multiple planes, such that the at least one input device may be conveniently actuated by the thumb of an operator. In one embodiment, faceplate 128 has input devices 132, 134, and 136 located on two planes of the faceplate. In this embodiment, input device 132 is a device that permits the operator to selectively instruct the machine to resume a previous speed, such as a push button device. Also, input device 134 is a device that controls the machine's moving speed, such as a roller device, which allows for precise speed control and a plurality of exact speeds. Further, input device 136 is a device that controls the gear setting for the machine's transmission, such as a switch that clearly places the transmission in forward, neutral, or reverse.

FIG. 4 detail lower housing 112 and clamp 322, which is incorporated in the joystick assembly to facilitate attachment of the palm support 110 to a clockspring base 510. Clamp 322 may be integrally formed with lower housing 112 or joined with lower housing 112 using any known appropriate joining mechanism, such as snap fitting, adhesives, or fasteners. As shown in FIG. 4, clamp fasteners 324 may be used to join clamp 322 to lower housing 112, and further securing may be accomplished via fastener securing member 320 (shown in FIG. 3).

Turning to FIG. 5, clockspring base 510 provides a securing means to some other feature of the machine, such as an armrest of an operator's chair. Clockspring base 510 may be secured to another machine feature via any known appropriate joining means, and may also be integrally formed with said machine feature. As seen in FIG. 5, said appropriate joining means may be a base fastener 516, such as a screw. Moreover, clockspring base 510 includes a clockspring 520, which facilitates operator input regarding turning the machine to the right or left. Clockspring 520 has one vertical axis, which is generally, but not always, found near the middle of the clockspring. The vertical axis extends through clockspring base 510, lower housing 112, upper housing 114, and is generally perpendicular to the palm support 110. In the preferred embodiment, the clockspring is the only movable features of the joystick assembly that receives input from the operator, other than the previously noted input devices.

Clockspring base 510 also includes a main harness 514 for connection to a wire connector 512. By incorporating the main harness 514 in clockspring base 510, clockspring base 510 also provides enhanced reliability and integrity with clockspring 520 over other commonly used input devices, such as buttons or switches, by reducing the likelihood of wire breakage in the joystick assembly.

Figure 6:
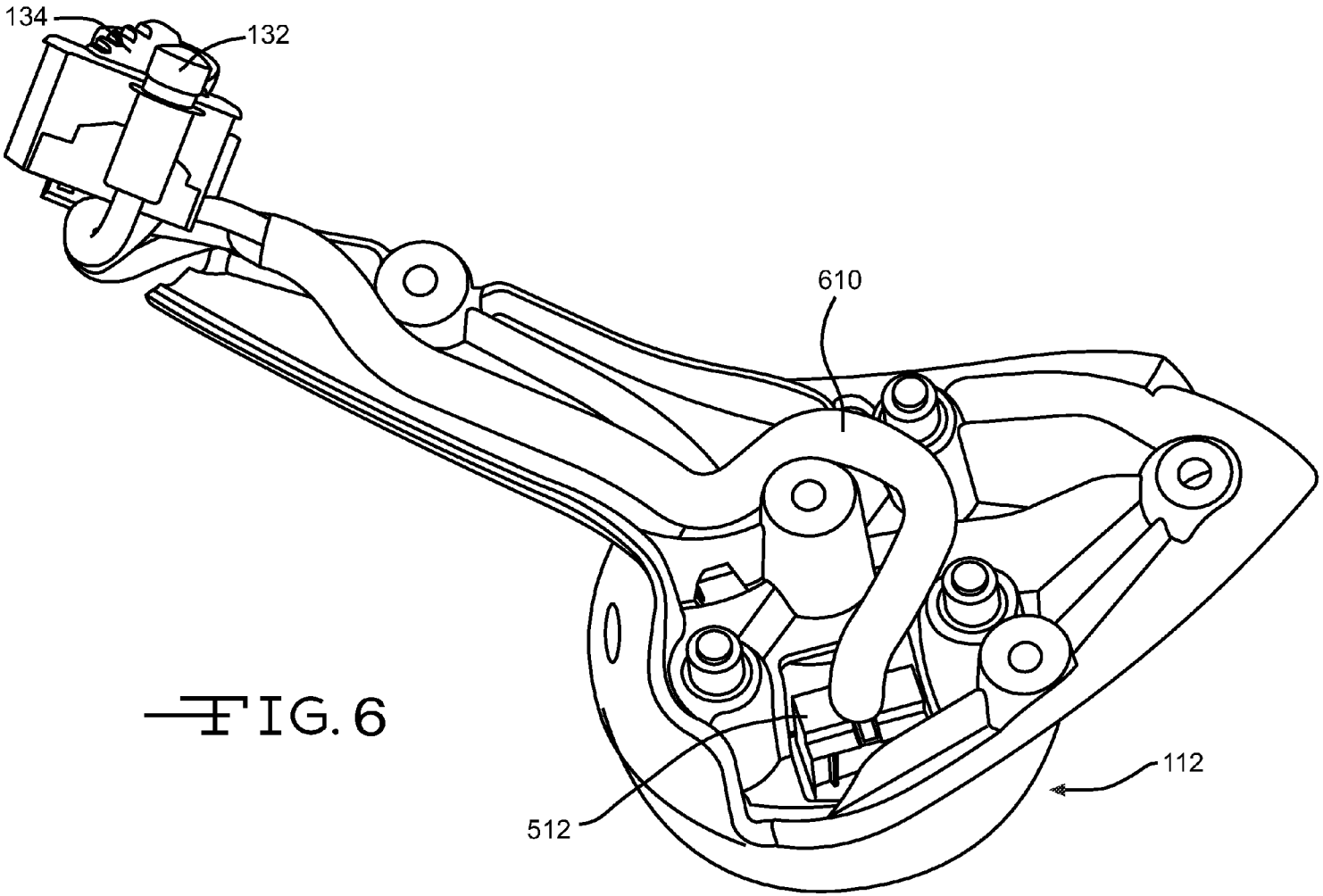
FIG. 6 is a schematic representation of the hand support's lower housing before application of the upper housing, showing the internal orientation of a control input harness within the hand support's lower housing.

Further, as shown in FIG. 6, the joystick assembly may include a data wire 610 that is electrically connected to the input device(s) of the interface device and terminates in wire connector 512. In the embodiment detailed above wherein the interface device has three input devices, a separate data wire is electrically connected to each input device and terminates in wire connector 512. When wire connector 512 is connected to main harness 514, main harness 514 may facilitate electrical connection between the input devices and an electronic control unit (not shown). Alternatively, the data wire(s), wire connector 512, and main harness 514 may be replaced or removed when the joystick assembly includes a wireless transmitter (not shown) for transmitting the electrical signals from the actuation of the input device(s) and clockspring position to an electronic control unit.

The various components of the joystick assembly, namely, the upper housing, the lower housing, the interface device, and the clockspring base portion may all be joined by any means commonly known in the art. For example, the components of the joystick assembly may be joined together via a plurality of mechanical fasteners, as shown in the exploded view found in FIG. 3. Alternatively, the joystick assembly components may be joined by, e.g., an adhesive or, if metallic, by welding, brazing, or soldering.

INDUSTRIAL APPLICABILITY

The joystick assembly may be used to enhance the stability of the operator of a machine during rough operation, while also providing precise operator wrist actuation for turning, as opposed to requiring gross movement of the operator's arm and shoulder. The joystick assembly may also improve operator stability and control precision as compared to joysticks having a twist grip feature when the joystick assembly presently disclosed is rigidly formed. As noted above, the joystick assembly may include a palm support with an upper housing that allows for multiple operator hand positions, a clockspring base portion with a clockspring having a vertical axis for improved machine control, and an interface device that may support at least one input device. The input device(s) may be electrically connected to a data cable terminating in a connector or may transmit input signals wirelessly. A machine utilizing such a joystick assembly may be, but is not limited to, a track-type tractor, a pipe layer, a motor grader, an excavator, or any other machine having an operator compartment.

Further, a plurality of input devices may be included in the control portion, each controlling a specific function of the machine. For example, one input device may control the machine's speed, one input device may permit the operator to selectively resume a previous machine speed, and one input device may control the gear setting of the machine's transmission. The input devices may be positioned on the input head for easy actuation by a thumb of an operator having a hand grip the joystick assembly.

It will be apparent to those skilled in the art that various modifications and variations can be made without departing from the scope or spirit of the invention. Additionally, other embodiments of the invention will be apparent to those skilled in the art from consideration of the specification and practice of the invention disclosed herein. It is intended that the specification and examples be considered as exemplary only.

What is claimed is:

1. A joystick assembly comprising:

a clockspring base having a vertical axis; and a grip assembly including a palm support and an interface device configured to generate electrical signals, the grip assembly being rotatably attached to the clockspring base such that the grip assembly only rotatably pivots about the vertical axis in a plane generally perpendicular to the vertical axis, wherein the palm support intersects the vertical axis, wherein the clockspring base further includes a clockspring configured to provide rotatable movement around the vertical axis relative to the clockspring base, the clockspring operable to maintain electrical communication from the interface device to an electronic control unit during rotation of the clockspring.

2. The joystick assembly of claim 1, wherein the palm support further includes a data wire coupled between the interface device and the clockspring.

3. The joystick assembly of claim 1, wherein the palm support further includes a wire connector to couple to the clockspring.

4. The joystick assembly of claim 3, wherein the clockspring further includes a main harness configured to mate with the wire connector.

5. The joystick assembly of claim 1, wherein the interface device further includes three input devices.

6. The joystick assembly of claim 5, wherein the interface device further includes three data wires, the interface device being configured such that each data wire is connected to one input device and such that each data wire is also connected to a wire connector to couple to the clockspring.

7. The joystick assembly of claim 5, wherein the input devices are a speed input control having variable input settings, a transmission input control, and a resume speed control.

8. The joystick assembly of claim 1, wherein the palm support further includes a data wire and a wire connector to which the data wire is terminated, the clockspring includes a main harness connected to the wire connector.

9. The joystick assembly of claim 1, wherein the clockspring is operable to generate electrical communication to the electronic control unit during rotation of the joystick assembly.

10. A joystick assembly comprising:

a clockspring base including a clockspring, the clockspring configured to provide rotatable movement around a vertical axis relative to the clockspring base; and a grip assembly including a palm support and an interface device;

wherein the palm support includes an upper housing and a lower housing and the interface device, the upper housing disposed about an upper housing axis, the interface device operable to generate electrical signals and the clockspring operable to facilitate electrical communication between the interface device and an electronic control unit during rotation of the clockspring; and wherein the joystick assembly is only rotatable about the vertical axis of the clockspring, the vertical axis being generally perpendicular to the upper housing axis.

11. The joystick assembly of claim 10, wherein the palm support further includes a data wire coupled between the interface device and the clockspring.

12. The joystick assembly of claim 10, wherein the palm support further includes a wire connector to couple to the clockspring.

13. The joystick assembly of claim 12, wherein the clockspring further includes a main harness configured to mate with the wire connector.

14. The joystick assembly of claim 10, wherein the interface device has three input devices.

15. The joystick assembly of claim 14, wherein the input devices are a speed input control having variable input settings, a transmission input control, and a resume speed control.

* * * * *